US007871584B2

(12) United States Patent
Liu et al.

(10) Patent No.: US 7,871,584 B2
(45) Date of Patent: Jan. 18, 2011

(54) CONSECUTIVE OR SIMULTANEOUS LEACHING OF NICKEL AND COBALT CONTAINING ORES

(75) Inventors: Houyuan Liu, Shortland (AU); Alexey Duarte, Perth Western (AU); Wolf Meihack, Brisbane (AU)

(73) Assignee: BHP Billiton SSM Technology Pty. Ltd., Perth (AU)

( * ) Notice: Subject to any disclaimer, the term of this patent is extended or adjusted under 35 U.S.C. 154(b) by 767 days.

(21) Appl. No.: 11/745,542

(22) Filed: May 8, 2007

(65) Prior Publication Data

US 2008/0050294 A1 Feb. 28, 2008

(51) Int. Cl.
*C22B 3/00* (2006.01)

(52) U.S. Cl. ..... 423/150.4; 423/150.5; 423/139; 423/140; 423/141; 423/142; 423/143; 423/144; 423/145; 423/146; 423/147; 423/164

(58) Field of Classification Search ..... 423/139–147, 423/150.1–150.4, 150.5, 164; 75/743
See application file for complete search history.

(56) References Cited

U.S. PATENT DOCUMENTS

| | | | | |
|---|---|---|---|---|
| 4,548,794 | A | 10/1985 | Lowenhaupt et al. | |
| 6,261,527 | B1 * | 7/2001 | Arroyo et al. | 423/140 |
| 6,280,501 | B1 * | 8/2001 | Ferron | 75/743 |
| 2002/0041840 | A1 * | 4/2002 | Arroyo et al. | 423/145 |

FOREIGN PATENT DOCUMENTS

| | | | |
|---|---|---|---|
| AU | 199052057 | | 9/1990 |
| AU | 200072233 | | 6/2001 |
| CA | 1044022 | A | 12/1978 |
| CA | 2064543 | A | 10/1993 |
| WO | WO 00/68445 | | 11/2000 |
| WO | WO 01/32943 | | 5/2001 |
| WO | WO 01/32944 | | 5/2001 |
| WO | WO 03/093517 | | 11/2003 |

* cited by examiner

*Primary Examiner*—Steven Bos
(74) *Attorney, Agent, or Firm*—Brinks Hofer Gilson & Lione; G. Peter Nichols

(57) ABSTRACT

A process for the recovery of nickel and cobalt from nickel and cobalt containing ores, including the steps of first leaching a laterite ore and/or a partially oxidized sulfide ore with an acid solution to produce a pregnant leach solution containing at least dissolved nickel, cobalt and ferric ions, and subsequently leaching a sulfide ore or concentrate with the pregnant leach solution to produce a product liquor. Alternatively, the laterite ore and/or partially oxidized sulfide ore can be leached in a combined leach with the sulfide ore or concentrate. The ferric ion content in the pregnant leach solution or in the combined leach is sufficient to maintain the oxidation and reduction potential in the sulfide leach high enough to assist in leaching nickel from the sulfide ore or concentrate.

28 Claims, 7 Drawing Sheets

CONSECUTIVE OR SIMULTANEOUS LEACHING OF NICKEL AND COBALT CONTAINING ORES

This application claims priority from PCT/AU2005/001734 published in English on May 26, 2006 as WO 2006/053376, which itself claims priority from AU 2004906563 filed Nov. 17, 2004, the entire contents of each are incorporated herein by reference.

The present invention relates to a new hydrometallurgical process for recovering nickel and cobalt from sulfide ores and concentrates and laterite and/or partially oxidised sulfide ores. In general, the process involves either consecutively or simultaneously heap or atmospheric pressure agitation leaching of a laterite and/or partially oxidised sulfide ore, and a sulfide ore or concentrate, in order to process both ore types in an efficient nickel and cobalt recovery process. It has been found that ferric ions released during the leaching of laterite and/or partially oxidised sulfide ores may be used as a lixiviant and/or oxidant to leach nickel and cobalt from sulfide ores or concentrates. The process is particularly applicable to the treatment of a nickel containing sulfide ore body having an oxidized cap, or for processing a sulfide ore body where part of the ore body has been partially oxidised, or deposits where laterite and sulfide ore deposits are geographically close and both available.

The world nickel resources are divided into two major categories, sulfide ore and laterite ore. These are normally found in quite different locations, and it is usual for each type of ore to be processed independently.

The exploitation of sulfide ore is essentially a pyrometallurgical process involving open cut or underground mining, and then benefaction of the ore by first grinding the ore and then separating the impurities by flotation to concentrate the ore. The concentrated ore is then subjected to smelting to a nickel matte, and a refining process to recover nickel. Base metal sulfide smelting processes however, are inefficient in energy use due to incomplete oxidation of the sulfides and heat losses to off gases, slag, and product.

Another inefficiency is the high loss of cobalt values in slag from smelted nickel ores or concentrates. The smelting process also generates sulfur dioxide, often requiring the complication of a sulfuric acid plant addition to avoid the release of the sulfur dioxide to atmosphere.

In order to overcome some of the problems associated with sulfide smelting, a number of hydrometallurgical routes for processing nickel sulfide concentrates have been discussed in the literature, generally relying on grinding, or fine grinding of the concentrate, followed by oxidative pressure leaching of the sulfide to produce sulfuric acid for the leach process.

Biological treatment of nickel sulfides has also been described, where bacterially assisted leaching is followed by solution purification, metal separation, and electrowinning of nickel. The long residence times required for this type of process necessitates extremely large reactors for the leach stage, and the process has therefore not achieved commercial success to date due to the large capital requirements.

The proprietary "Activox" process relies on an extremely fine grind of the nickel concentrate followed by high pressure oxidative leaching to extract the nickel into a sulfate solution, followed by known impurity removal steps and recovery of the metallic nickel.

The hydrometallurgical processes described above generally have the disadvantage that much of the sulfur content of the sulfide is oxidised to higher valence species, such as sulfate and sulfite, with high costs of reagents for neutralisation, and generation of large amounts of waste, such as ammonium sulfate or gypsum requiring disposal.

The ability of ferric ion to attack metal sulfides has been published. Metal sulfide assisted leaching with ferric salt is a hydrometallurgical process described in D. J. I. Evans et al., International Symposium on Hydrometallurgy as shown by equation 1 where the ferric ions are converted to ferrous ions, but in this case the sulfur is rejected predominantly as elemental sulfur, rather than sulfate:

$$MeS+2Fe^{3+}=Me^{+2}+2Fe^{2+}+S^{0} \qquad \text{Equation 1}$$

where the stoichiometric weight ratio of $Fe^{3+}$ over $S^{2-}$ is 3.5:1.

The ferric ion can be added as either ferric chloride or ferric sulfate, and these have been disclosed for treatment of sulfides such as copper, zinc, nickel or cobalt. These iron based chemicals would be provided from external supply as raw materials for processing in this manner.

Some sulfide ore bodies however, have an oxidised cap, or partially oxidised regions in the deposit (oxidic ores). Oxidic ores are not readily beneficiated by use of the flotation method. Due to the difficulties of processing oxidic ores in this manner, and the need for separate processing of these materials, the oxidised cap of a sulfide ore body and partially oxidised ore are conventionally rejected.

The exploitation of laterite ores, on the other hand, is essentially a whole-of-ore layer process in that there is no effective method to separate or concentrate nickel and cobalt from the major impurities such as iron, magnesium and silicate. Laterite nickel and cobalt ore deposits generally contain oxidic type ores, namely limonites, and silicate type ores, namely saprolites as well as other fractions such as nontronites. Limonites and saprolites generally exist as two layers in the same deposits, separated by a transition zone. High grade limonite and saprolite are preferred for commercial processing to minimise the equipment size. This leads to the lower grade ores and transition ores in the same deposits also being rejected as waste.

The higher nickel content saprolites tend to be treated by a pyrometallurgical process involving roasting and electrical smelting techniques to produce ferronickel. The higher nickel and cobalt content limonite is normally commercially treated hydrometallurgically by the high pressure acid leach (HPAL) process, or a combination of pyrometallurgical and hydrometallurgical processes, such as the Caron reduction roast—ammonium carbonate leach process.

These processes are "whole ore" layer processes as there is no effective method to beneficiate the ore. This has the disadvantage that the mineralogical fractions of the ore which contain lower metal values effectively dilute the total treated ore quality and increase recovery costs. Other techniques have been developed to exploit laterite ore in the past decade apart from conventional high pressure acid leach (HPAL). For example enhanced pressure acid leach (EPAL) is described in U.S. Pat. No. 6,379,636 in the name of BHP Billiton. Atmospheric agitation with iron precipitation as jarosite is described in U.S. Pat. No. 6,261,527 also in the name of BHP Billiton and precipitation as goethite is described in Australian application 2003209829 in the name of QNI Technology. A process for direct atmospheric leaching of the saprolite component is described in U.S. Pat. No. 6,379,637 in the name of Curlook.

Heap leaching is a conventional method of economically extracting metals from low grade ores and has been successfully used to recover materials such as copper, gold, uranium and silver. Generally it involves piling raw ore directly from ore deposits into heaps. The leaching solution is introduced on to the top of the heap to percolate down through the heap. The effluent liquor is drained from the base of the heap and passes to a processing plant where the metal values are recovered. Heap leaching in recovery processes for nickel and cobalt are described for example in U.S. Pat. Nos. 5,571,308 and 6,312,500, both in the name of BHP Billiton.

The state of iron in laterite ore exist as ferric ions due to weathering oxidation. During atmospheric or heap leaching of laterite ores, a large amount of the ferric ions are dissolved into a pregnant leach solution and then precipitated as haematite, jarosite, goethite or hydroxides and then disposed as tailings. To remove the iron in this manner leads to a relatively high consumption of acid or neutralising agents such as limestone.

All the processes for sulfuric acid leaching of oxidic ores discussed above require large amounts of sulfuric acid and often require the complexity of a sulfuric acid plant together with the nickel refinery. To overcome this, processes have been proposed, such as the addition of pyrites or other sulfur containing material to the nickel laterite feed to a high pressure acid leach process, together with air, at temperatures in excess of 200° C., such that the sulfur component is oxidised to sulfuric acid, reducing or eliminating the sulfuric acid requirement. Two such processes are described in U.S. Pat. No. 3,809,549 (Opratko et al) and CA 947089 (O'Neill). These processes have the inherent disadvantages of the equipment complexity and metallurgical sophistication required for high pressure acid leaching, and tend to increase the iron waste disposal problem.

An improvement over the prior art would be an improved hydrometallurgical process for treating nickel sulfide ores or concentrates and laterite or partially oxidised sulfide ores together in the same process, for example, where the ores exist together in the same deposit, or where they exist in geographically close separate deposits to optimise the use of reagents, energy, and facilities.

One such process is described in patent AU 709751 (WMC Resources). In this process a mixture of sulfidic nickel ore or concentrate is mixed with an oxidic ore and oxidised with air at high pressure and above 180° C., the sulfide oxidising to sulfuric acid to leach the oxidic ore. The process does overcome some of the disadvantages of the separate processing of sulfides and oxides, but still has the disadvantages described above, associated with high pressure acid leaching.

A further improvement over the prior art would be an atmospheric pressure hydrometallurgical process, wherein nickel sulfide ore or concentrate, and a laterite and/or partially oxidised sulfide ore can be treated in the same process to recover nickel and cobalt.

The applicants have found that ferric ions, released during acid leaching of nickel containing laterites and/or partially oxidised sulfide ores, can be used as lixiviant and/or oxidant to leach nickel and cobalt from sulfide ores or concentrates. The applicants have found that this can be achieved during heap or atmospheric agitation leaching of the nickel and cobalt containing ores.

It is a desired feature of the present invention to utilise the ferric ions released during leaching of a laterite ore or partially oxidised sulfide ore in consecutive or simultaneous leaching of nickel from sulfide ores or concentrates.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In general, the present invention provides hydrometallurgical processes to recover nickel and cobalt by leaching a laterite and/or partially oxidised sulfide ore, and a sulfide ore or concentrate simultaneously or consecutively.

Ferric ions released during the laterite and/or partially oxidised sulfide ore leach are used as a lixiviant and/or an oxidant for the sulfide ore leach as they maintain the oxidation and reduction potential (ORP) in the sulfide leach high enough to assist in leaching the nickel and cobalt from the sulfide ore or concentrate. The process is particularly applicable to exploit a nickel and cobalt containing sulfide ore body having an oxidised cap or a partially oxidised portion, or deposits where both nickel and cobalt laterite and sulfide ores are geographically close.

Accordingly, in a first aspect of the present invention there is provided a process for the recovery of nickel and cobalt from nickel and cobalt containing ores, said process including the steps of:

(a) providing
  i) a laterite ore and/or a partially oxidised sulfide ore, and
  ii) a sulfide ore or concentrate;
(b) leaching the laterite ore and/or partially oxidised sulfide ore with an acid solution in a primary leach step, to produce a pregnant leach solution containing at least dissolved nickel, cobalt and ferric ions;
(c) leaching the sulfide ore or concentrate with the pregnant leach solution in a secondary leach step to produce a product liquor containing nickel and cobalt; and
(d) recovering the nickel and cobalt from the product liquor;

wherein the ferric ion content in the pregnant leach solution is sufficient to maintain the oxidation and reduction potential in the secondary leach high enough to assist in leaching nickel and cobalt from the sulfide ore.

The term "laterite" as used herein is inclusive of the whole ore, or any one or more of its component fractions, such as the limonite, saprolite or nontronite fractions.

The partially oxidised sulfide ore component includes the oxidised cap which is often associated with sulfide ore bodies due to weathering, or partially oxidised sulfide ore found beneath the surface.

The term sulfide ore or concentrate is inclusive of a transition sulfide ore that may have undergone a minor degree of oxidation but retaining its sulfide characteristics.

The laterite and/or partially oxidised sulfide ore, and the sulfide ore used in the process will generally be mined separately. Prior to processing, the sulfide ore may be beneficiated to produce a concentrate. The process of the invention is equally applicable to processing the sulfide ore or concentrate.

In a preferred embodiment, the laterite ore may be processed by first separating the limonite ore into its limonite and saprolite fractions and leaching the limonite and saprolite fractions separately. That is, either the limonite or saprolite fraction is leached separately in a primary leach step to produce a pregnant leach solution which is then subsequently used to leach the sulfide ore or concentrate in the secondary leach step. The other component, either the limonite or saprolite which is not used in the primary leach step, may be leached separately to produce a limonite or saprolite fraction leachate containing dissolved nickel, cobalt and ferric ions. This limonite or saprolite fraction leachate may be combined with the product liquor from the secondary leach step or alternatively, added to the secondary leach step if insufficient ferric ions are available for that step. Nickel and cobalt are then recovered from the product liquor by standard recovery techniques.

Accordingly, in a preferred embodiment, the process includes the further steps of:

(a) separating the laterite ore into its limonite and saprolite fractions;
(b) leaching the limonite fraction with an acid solution in a primary leach step to produce the pregnant leach solution containing at least dissolved nickel, cobalt and ferric ions;
(c) leaching the sulfide ore or concentrate with the pregnant leach solution in a secondary leach step to produce a product liquor containing dissolved nickel and cobalt ions;
(d) separately leaching the saprolite fraction to produce a saprolite fraction leachate;
(e) adding the saprolite fraction leachate to either the product liquor or to the secondary leach step; and
(f) recovering nickel from the product liquor;

wherein the ferric ion content in the pregnant leach solution is sufficient to maintain the oxidation and reduction potential in the secondary leach high enough to assist in leaching nickel and cobalt from the sulfide ore.

In yet a further preferred embodiment where the saprolite fraction is used in the primary leach step, the process includes the further steps of:

(a) separating the laterite ore into its limonite and saprolite fractions;
(b) leaching the saprolite fraction with an acid solution in a primary leach step to produce the pregnant leach solution containing at least dissolved nickel, cobalt and ferric ions;
(c) leaching the sulfide ore with the pregnant leach solution in a secondary leach step to produce a product liquor containing dissolved nickel and cobalt ions;
(d) separately leaching the limonite fraction to produce limonite fraction leachate;
(e) adding the limonite fraction leachate to either the product liquor or to the secondary leach step; and
(f) recovering nickel and cobalt from the product liquor;

wherein the ferric ion content in the pregnant leach solution is sufficient to maintain the oxidation and reduction potential in the secondary leach high enough to assist in leaching nickel and cobalt from the sulfide ore.

The laterite ore may be further separated into its nontronite fraction. The nontronite fraction may be used in place of, or together with either of the saprolite or limonite fractions in these preferred processes.

In a further embodiment, the laterite and/or partially oxidised sulfide ore is leached simultaneously with the sulfide ore or concentrate in a combined leach. The ferric ions are released from the laterite and/or partially oxidised sulfide ore within the combined leach and assist in leaching of nickel and cobalt from the sulfide ore or concentrate. This is achieved by blending each of the ores together prior to leaching so they are leached simultaneously.

Accordingly, in a further aspect of the invention, there is provided a process for the recovery of nickel and cobalt from nickel and cobalt containing ores, said process including the steps of:

(a) providing
  i) a laterite and/or partially oxidised sulfide ore; and
  ii) a sulfide ore or concentrate
(b) combining the sulfide ore and the laterite or partially oxidised sulfide ore and leaching simultaneously the ores with an acid solution in a combined leach step to produce a product liquor containing dissolved nickel and cobalt ions; and
(c) recovering nickel and cobalt from the product liquor;

wherein the content of ferric ion released within the combined leach step is sufficient to maintain the oxidation and reduction potential high enough to assist in leaching nickel and cobalt from the sulfide ore or concentrate.

In a further preferred embodiment, the laterite ore may still be separated into its limonite and saprolite fractions, and either the limonite or saprolite fraction is blended with the sulfide ore for simultaneous leaching. Accordingly, in a preferred embodiment, where the ores are leached simultaneously, the process includes the further steps of:

(a) separating the laterite ore into its limonite and saprolite fractions;
(b) combining the limonite fraction with the sulfide ore and leaching simultaneously the sulfide ore and the limonite fraction with an acid solution in a combined leach step, to produce a product liquor containing dissolved nickel and cobalt ions;
(c) leaching separately the saprolite fraction to produce a saprolite fraction leachate; and
(d) adding the saprolite fraction leachate to either the product liquor or the combined leach; and
(e) recovering the nickel and cobalt from the product liquor;

wherein the ferric ion content released within the combined leach is sufficient to maintain the oxidation and reduction potential in the combined leach step high enough to assist in leaching nickel and cobalt from the sulfide ore.

In yet a further preferred embodiment, where the saprolite fraction is used in the combined leach step rather than the limonite fraction, the process includes the further steps of:

(a) separating the laterite ore into its limonite and saprolite fractions;
(b) combining the saprolite fraction with the sulfide ore and leaching simultaneously the sulfide ore and the saprolite fraction with an acid solution in a combined leach step, to produce a product liquor containing dissolved nickel and cobalt ions;
(c) leaching separately the limonite fraction to produce a limonite fraction leachate;
(d) adding the limonite fraction leachate to either the product liquor or the combined leach step; and
(e) recovering the nickel and cobalt from the product liquor;

wherein the content of ferric ion released within the combined leach is sufficient to maintain the oxidation and reduction potential high enough to assist in leaching nickel and cobalt from the sulfide ore.

Again, the laterite ore may be further separated into its nontronite fraction in these preferred processes, and the nontronite fraction may be used in place of, or together with either of the saprolite or limonite fractions.

Most preferably, the primary leach of the laterite and/or partially oxidised sulfide ore, the secondary leach of the sulfide ore or concentrate, and the combined leach, are heap leach or atmospheric agitation leach processes. The saprolite or limonite fractions are also preferably leached by heap or atmospheric agitation leaching to produce the limonite or saprolite fraction leachates. Atmospheric pressure leaching favours the release of ferric ions from the laterite and/or partially oxidised sulfide ores under these conditions.

The ferric ion content produced in the pregnant leach solution or in the combined leach step is sufficient to maintain the oxidation and reduction potential within the sulfide ore leaching steps, high enough within the leach to assist in leaching nickel and cobalt from the sulfide ore. The ferric ion is able to act as a lixiviant and/or oxidant to assist in leaching the nickel and cobalt from the sulfide ore and improve nickel and cobalt recovery. Generally, the ferric ion content in the pregnant leach solution is greater than 10 g/L, preferably 30 g/L. Most preferably the ferric ion content in the pregnant leach solution is sufficient to maintain the oxidation and reduction potential within the sulfide leach steps, whether it be the secondary leach in a consecutive leach process, or a combined leach, between 690 to 900 mv (SHE), most preferably between 740 to 820 mv (SHE).

In a further embodiment, where there is insufficient ferric ion available for the sulfide ore or concentrate leach step as there is an insufficient ratio of laterite and/or partially oxidised sulfide ore to sulfide ore or concentrate, the sulfide ore or concentrate leach step may be sparged with air or oxygen in order to maintain the oxidation and reduction potential at the preferred levels.

Alternatively, the saprolite or limonite fraction leachate may be added to the sulfide leach step, as an additional source of ferric ions, if necessary to assist in maintaining the oxidation and reduction potential at the preferred levels.

The heap leach or atmospheric pressure agitation leach of the laterite and/or partially oxidised sulfide ore, and the sulfide ore or concentrate is preferably leached with an acid solution wherein the acid is either hydrochloric or sulfuric acid. Hydrochloric acid has an advantage in that it may be recovered by pyrohydrolysis and recirculated to use in a primary leach step.

Accordingly, in yet a further preferred embodiment where hydrochloric acid is used in the heap or atmospheric pressure agitation leach, a portion of the hydrochloric acid is recovered from the product liquor by pyrohydrolysis, and then be recirculated to either the primary or combined leach steps in the processes described.

The nickel and cobalt may be recovered from the product liquor by standard techniques. Such techniques include ion exchange, solvent extraction, neutralisation, carbonation or sulfidisation. The nickel and cobalt may be recovered as pure or mixed hydroxides, sulfides or carbonates, or the nickel may be recovered as ferro nickel or nickel matte.

BRIEF DESCRIPTION OF THE DRAWINGS

The invention is further described by way of examples with reference to the accompanying drawings.

DESCRIPTION

Figure 1:
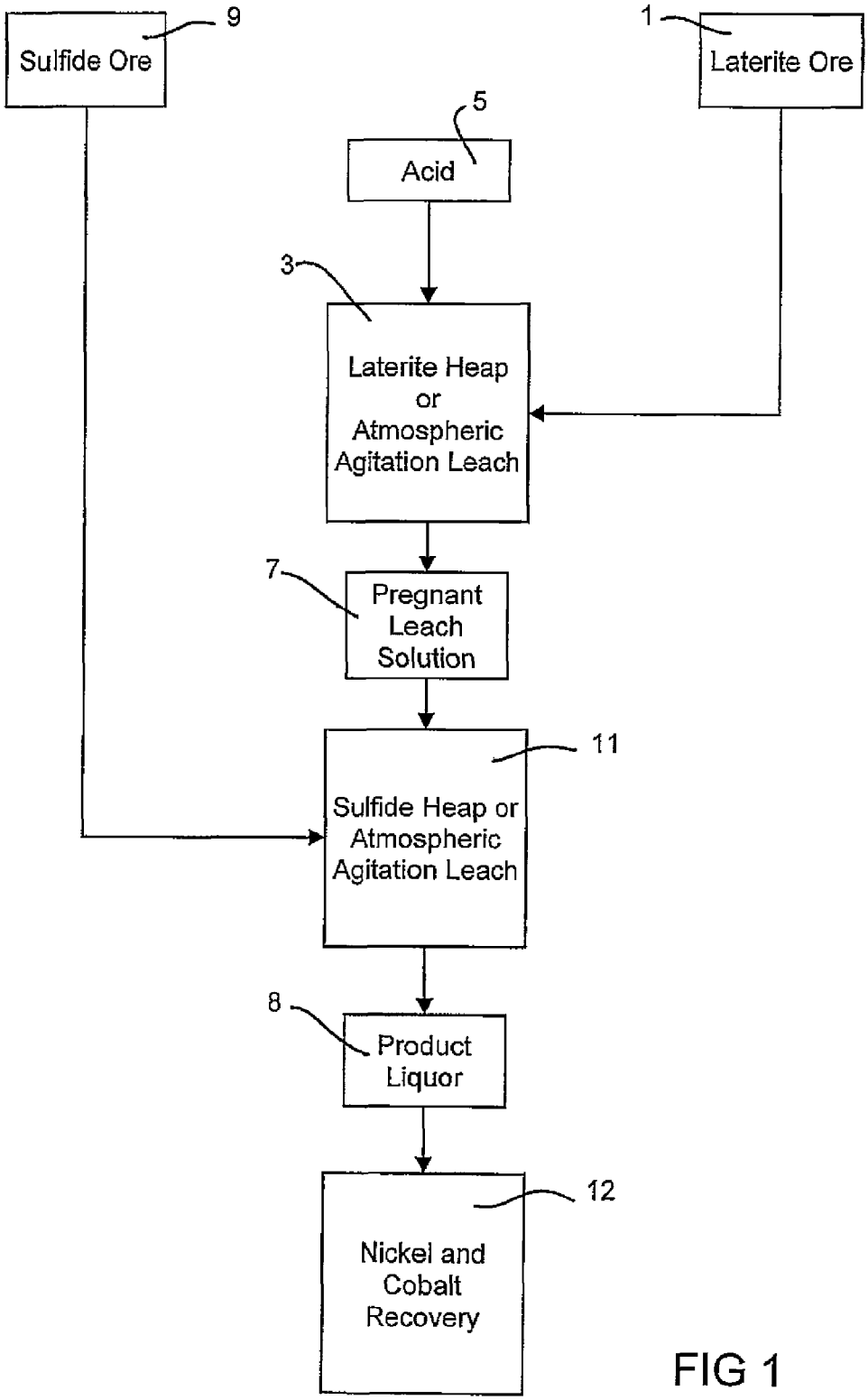
FIG. 1 illustrates an embodiment of the invention where a laterite and a sulfide ore or concentrate are leached consecutively in a primary and secondary leach.

The process of the present invention is particularly applicable to the recovery of nickel and cobalt by co-processing both nickel and cobalt containing laterite ores and/or partially oxidised sulfide ores, together with a nickel and cobalt containing sulfide ore or concentrate. The process utilises the ferric ions released during the leaching of the laterite and/or partially oxidised sulfide ore to assist in leaching nickel and cobalt from the sulfide ore or concentrate.

Laterite ores generally consist of both an oxidic type limonite and silicate type saprolite and nontronite components. The limonite component of the laterite ore generally contains from about 30-40 wt % iron while saprolite contains about 10-18 wt % iron. Nontronite contains about 20 wt % iron, 2-6 wt % aluminium and 18-22 wt % silicon. The iron generally is present as ferric ions. Table 1 lists the chemical composition of some typical limonite and saprolite ore bodies.

TABLE 1

Iron, Nickel and Cobalt Concentrations (% wt) in Various Laterite Ores

| Ore Type | Fe | Mg | Ni | Co | Fe/Ni ratio |
|---|---|---|---|---|---|
| Indonesian limonite | 40.8 | 1.30 | 1.53 | 0.10 | 27 |
| Indonesian saprolite | 8.5 | 14.60 | 3.37 | 0.03 | 3 |
| Indonesian saprolite with High Fe content | 18.5 | 11.10 | 2.18 | 0.14 | 9 |
| New Caledonian limonite | 47.1 | 0.40 | 1.33 | 0.16 | 35 |
| New Caledonian saprolite | 7.7 | 23.3 | 1.00 | 0.02 | 8 |
| Western Australian low-Mg ore | 25.4 | 4.90 | 2.50 | 0.07 | 10 |
| Western Australian high-Mg ore | 10.0 | 16.6 | 1.38 | 0.02 | 7 |
| Tropical low-Mg nontronite ore | 21.6 | 2.60 | 1.80 | 0.05 | 12 |
| Tropical high-Mg nontronite ore | 18.8 | 8.30 | 1.17 | 0.04 | 16 |

Under heap leaching or atmospheric pressure leaching, such as those described in U.S. Pat. Nos. 5,571,308, 6,312,500, 6,261,527 and Australian Application 2003209829, the pregnant leach solution following leaching of laterite ore as a whole, contains about 10-30 g/L $Fe^{+3}$, typically about 20 g/L $Fe^{+3}$. Preferably in the process of the present invention, the pregnant leach solution will contain at least 10 g/L $Fe^{3+}$ most preferably about 30 g/L $Fe^{3+}$. When the limonite and saprolite components of a laterite ore are leached separately, atmospheric pressure agitation of the limonite component may produce over 100 g/L $Fe^{+3}$ in the pregnant leach solution, while the pregnant leach solution following saprolite leaching may contain over 30 g/L $Fe^{+3}$. The pregnant leach solution from the limonite and saprolite leach are a good source of ferric ions that may be used to assist in the leaching of nickel and cobalt from sulfide ores. Alternatively, the nontronite fraction may be used instead of, or together with either the limonite or saprolite fractions.

The level of ferric ions should be sufficient in order to maintain the oxidation and reduction potential in the sulfide leach step high enough to assist in leaching nickel and cobalt from the sulfide ore or concentrate. It is a function of the concentration of ferric ions, sulfide ions and low-valence sulfur ion species during the sulfide ore or concentrate leaching step that assists in leaching nickel and cobalt from the sulfide ore or concentrate and improves nickel recovery in the product liquor. The oxidation and reduction potential during the leach is preferably maintained between 690 to 900 mv (SHE), most preferably within the range of 740 to 820 mv (SHE).

It is preferred in the process of the present invention to first separate the laterite ore into its limonite and saprolite fractions, and possibly also its nontronite fraction to maximise ferric ion dissolution and the available ferric ions for the sulfide ore or concentrate leach.

Either the limonite saprolite or nontronite fraction of the laterite ore may be utilised as a source of ferric ions to assist in the leaching of the sulfide ore. That is, either the limonite, saprolite or nontronite fraction may be first leached with an acid solution to release the ferric ions and produce a pregnant leach solution containing ferric ions. That pregnant leach solution may then be used to leach the sulfide ore or concentrate. Alternatively, one or more of the limonite, saprolite or nontronite fraction can be combined with the sulfide ore or concentrate in a combined leach process where ferric ions released from the limonite, saprolite or nontronite fraction will assist in leaching the sulfide ore or concentrate.

The limonite, saprolite or nontronite fractions which are not utilised either in a consecutive or combined leach with the sulfide ore or concentrate may then be leached separately. Again, it is preferred that this leach is either a heap or atmospheric agitation leach. At least nickel, cobalt and ferric ions will be released during this leach to produce either a limonite, saprolite or nontronite fraction leachate containing at least nickel, cobalt and ferric ions. If insufficient ferric ions are available during this sulfide ore leach to maintain the oxidation and reduction potential in the preferred ranges, the limonite, saprolite or nontronite fraction leachate from the separate leach may be combined with the sulfide leach step to provide an extra source of ferric ions. However in general, the limonite, saprolite or nontronite fraction leachate can simply be added to the product liquor produced from the sulfide leach step. Nickel and cobalt may then be recovered from the product liquor.

The ratio of laterite and/or partially oxidised sulfide ore to sulfide ore or concentrate should be such so as to allow sufficient ferric ion to be available for the sulfide leach step to maintain the oxidation and reduction potential high enough in the sulfide leach step to assist in leaching nickel and cobalt from the sulfide ore or concentrate. However, if there is insufficient laterite or partially oxidised sulfide ore such that when leached, insufficient ferric ions are released to maintain the oxidation and reduction potential at the preferred levels of between 690 to 900 mv (SHE) for the sulfide leach step, the sulfide ore or concentrate leach may be sparged with air or oxygen in order to maintain the oxidation and reduction potential at the preferred level.

Table 2 illustrates the stoichiometrically calculated maximum sulfide iron ($S^{-2}$) percentage in nickel sulfide ore that could be oxidised with the use of ferric ions released in heap leaching or atmospheric pressure agitation leaching with the pregnant leach solution produced from leaching of saprolite and limonite.

TABLE 2

| Leaching Pregnant Leach Solution | $Fe^{+3}$ g/L | Pregnant Leach Solution/Sulfide Ore Ratio L/Kg | Max. $S^{-2}$ in Ore % |
|---|---|---|---|
| Heap leach | 20 | 10:1 | 6% |
| Limonite agitation leach | 100 | 3.1 | 9% |
| Saprolite agitation leach | 30 | 3:1 | 3% |

The calculated $S^{-2}$ content is believed to be much higher than that of raw nickel sulfide ore. Therefore, using the pregnant leach solution from a heap leach or atmospheric agitation leach of the saprolite or limonite component of a laterite ore or partially oxidised sulfide ore component is an effective way to treat sulfide ore to assist in the leach of nickel as a nickel sulfide.

The ferrous ions formed during the leaching of sulfide ore has the advantage in nickel and cobalt recovery in that the ferrous ion may be removed with the use of an ion exchange resin. For example, DOWEX M4195 (a styrene-divinylbenzene chelating resin with bis-picolylamine functional groups) has the selectivity of $Ni^{+2}>Fe^{+3}>>Fe^{+2}$. Most chelating ion exchange resins have selectivity in the order of $Fe^{+3}>Ni^{+2}>>Fe^{+2}$.

It is preferred that either the heap leaching or atmospheric pressure agitation leaching is conducted with hydrochloric acid. In hydrochloric acid leaching, the oxidation of ferrous ions to ferric ions benefits the recovery of acid with pyrohydrolysis and to avoid the iron treatment by precipitating ferric ion as hydroxide, as shown in equations 2 and 3:

$$2FeCl_2+2H_2O+0.5O_2=Fe_2O_3+HCl; \text{ and} \quad \text{(Equation 2)}$$

$$3FeCl_2+3H_2O+0.5O_2=Fe_3O_4+HCl \quad \text{(Equation 3)}$$

The recovery of hydrochloric acid while producing MgO, $Fe_2O_3$ and $Fe_3O_4$ may therefore be incorporated into the process.

An added benefit of the invention is that the ferric ion, which is effectively a waste product of laterite or oxidic nickel ore acid leaching, may be profitably used to substantially reduce the reagent requirements such as ferric chloride or sulphate, sulfuric or hydrochloric acid, air or oxygen, otherwise required for hydrometallurgical processing of nickel sulfide ore or concentrate.

An added benefit of the joint processing of nickel containing laterite and/or partially oxidised sulfide ore and the sulfidic ore is that the thermal energy generated in the exothermic oxidation of the sulfide may be able to be used in the endothermic leaching of the laterite or partially oxidised sulfide ores.

It is to be understood that these drawings are illustrative of preferred embodiments of the invention, and the invention should not be considered to be limited thereto.

FIG. 1 illustrates an embodiment of the process where a laterite ore (1) is subjected to a heap leach or atmospheric agitation leach (3) with the addition of acid solution (5) in a primary leach step. A partially oxidised sulfide ore may be used instead, or together with the laterite ore in this primary leach step. The primary leach step produces a pregnant leach solution (7) containing at least dissolved nickel, cobalt and ferric ions. The acid used in the primary leach step is either a hydrochloric or sulfuric acid solution, but a hydrochloric acid solution is preferred.

The pregnant leach solution (7) is then used to leach a sulfide ore or concentrate (9) in either a heap or atmospheric agitation leach (11) in a secondary leach step to produce a product liquor (8). The ferric ion content in the pregnant leach solution (7) is sufficient to maintain the oxidation and reduction potential in the secondary leach step high enough to assist in leaching the nickel and cobalt from the sulfide ore or concentrate. The resultant product liquor (8) contains dissolved nickel and cobalt ions which are recovered by standard recovery processes (12), such as ion exchange, solvent extraction, neutralisation, carbonation or sulfidisation.

Figure 2:
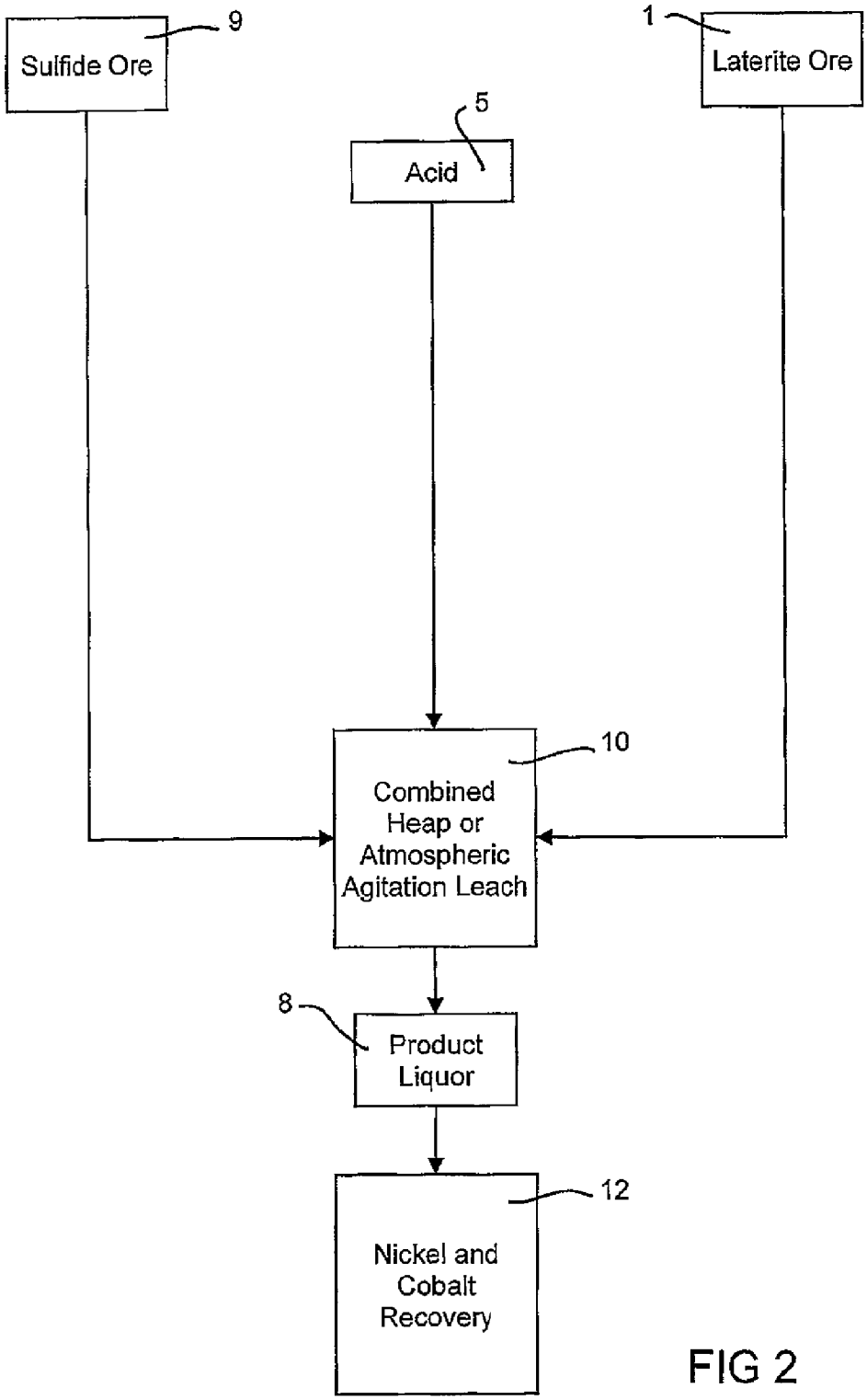
FIG. 2 illustrates an embodiment where the laterite ore and the sulfide ore are leached simultaneously in a combined leach.

FIG. 2 illustrates an embodiment of the process where the laterite ore (1) is leached simultaneously with the sulfide ore or concentrate (9) in either a combined heap or atmospheric agitation leach (10) with the addition of an acid solution (5). Again, a partially oxidised sulfide ore could be used instead or together with the laterite ore. The combined heap or atmospheric agitation leach produces a product liquor (8) containing at least dissolved nickel and cobalt ions.

In the combined sulfide and laterite ore leach, the ferric ion content produced within the leach is sufficient to maintain the oxidation and reduction potential high enough to assist in leaching nickel and cobalt from the sulfide ore or concentrate. Nickel and cobalt are then recovered by standard recovery processes (12) such as ion exchange, solvent extraction, neutralisation, carbonation or sulfidisation from product liquor (8).

Figure 3:
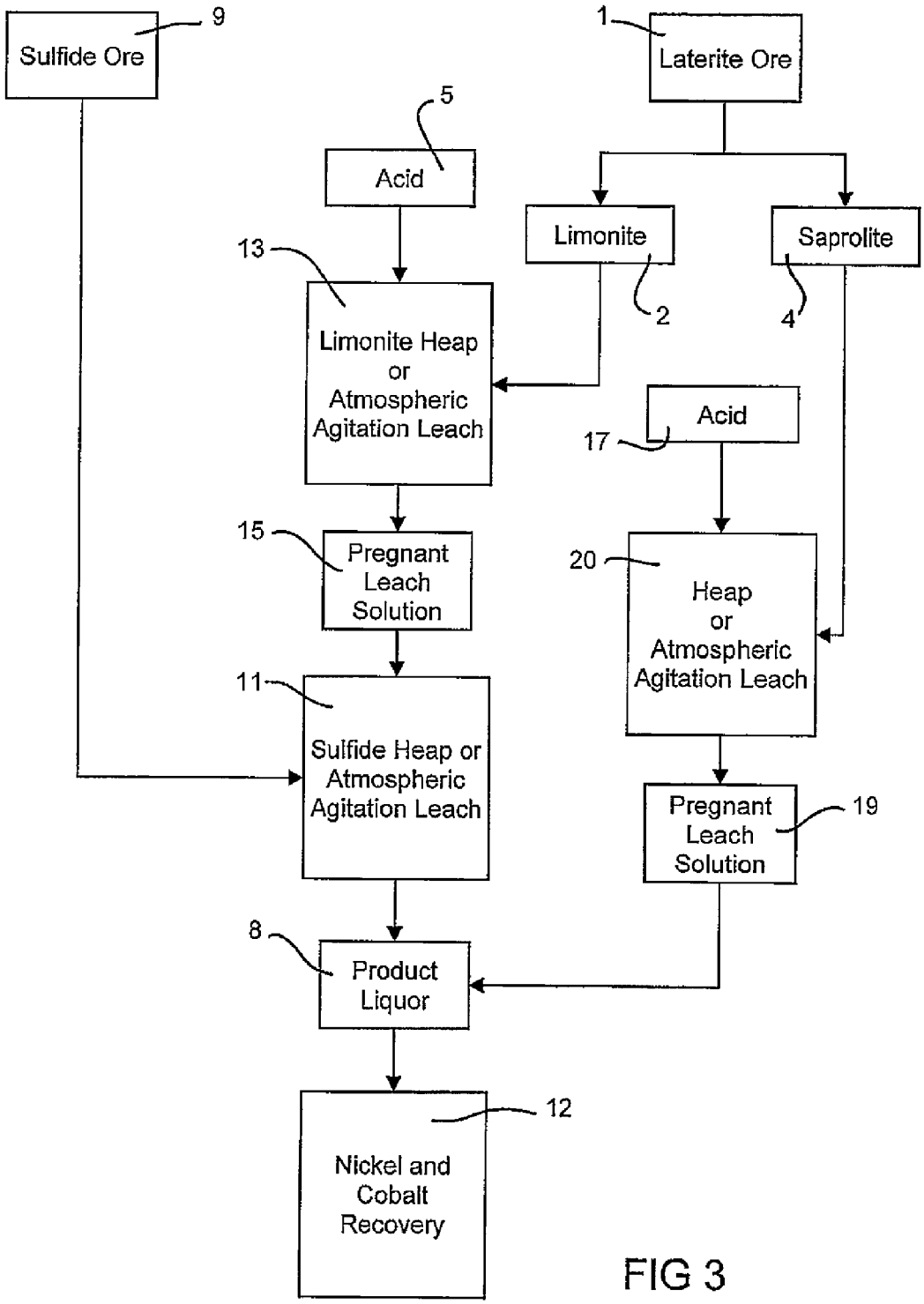
FIG. 3 illustrates an embodiment where the laterite ore is separated into its limonite and saprolite fractions. The limonite fraction is leached consecutively with the sulfide ore or concentrate in primary and secondary leach steps, while the saprolite fraction is leached separately. The saprolite fraction leachate from the saprolite leach is combined with the product liquor of the secondary leach.

FIG. 3 illustrates a consecutive leaching process similar to that of FIG. 1, but wherein the laterite ore (1) is first separated into its limonite fraction (2) and its saprolite fraction (4) for separate leaching. The limonite fraction (2) is subjected to an acid heap or atmospheric agitation leach (13) by the addition of acid solution (5), preferably a hydrochloric or sulfuric acid solution in a primary leach step to produce a pregnant leach solution (15). The pregnant leach solution contains at least dissolved ferric, nickel and cobalt ions. The pregnant leach solution from the primary leach step is then used to leach the sulfide ore or concentrate (9) in a heap or atmospheric agitation leach process (11) in a secondary leach step. The ferric ion content in the pregnant leach solution is sufficient to maintain the oxidation and reduction potential high enough in the secondary leach step to assist in leaching nickel and cobalt from the sulfide ore component.

The saprolite fraction (4) is separately subjected to a heap or atmospheric agitation leach (20) by the addition of acid solution (17). The saprolite fraction leachate from the saprolite leach (19) containing at least dissolved nickel, ferric and cobalt ions is then added to the product liquor (8) from the secondary sulfide leach. Alternatively, the saprolite fraction leachate may be added directly into the secondary leach step, if insufficient ferric ions are available during this step. Nickel and cobalt are recovered from the product liquor by conventional means (12) such as ion exchange, solvent extraction, neutralisation, carbonation or sulfidisation.

Figure 4:
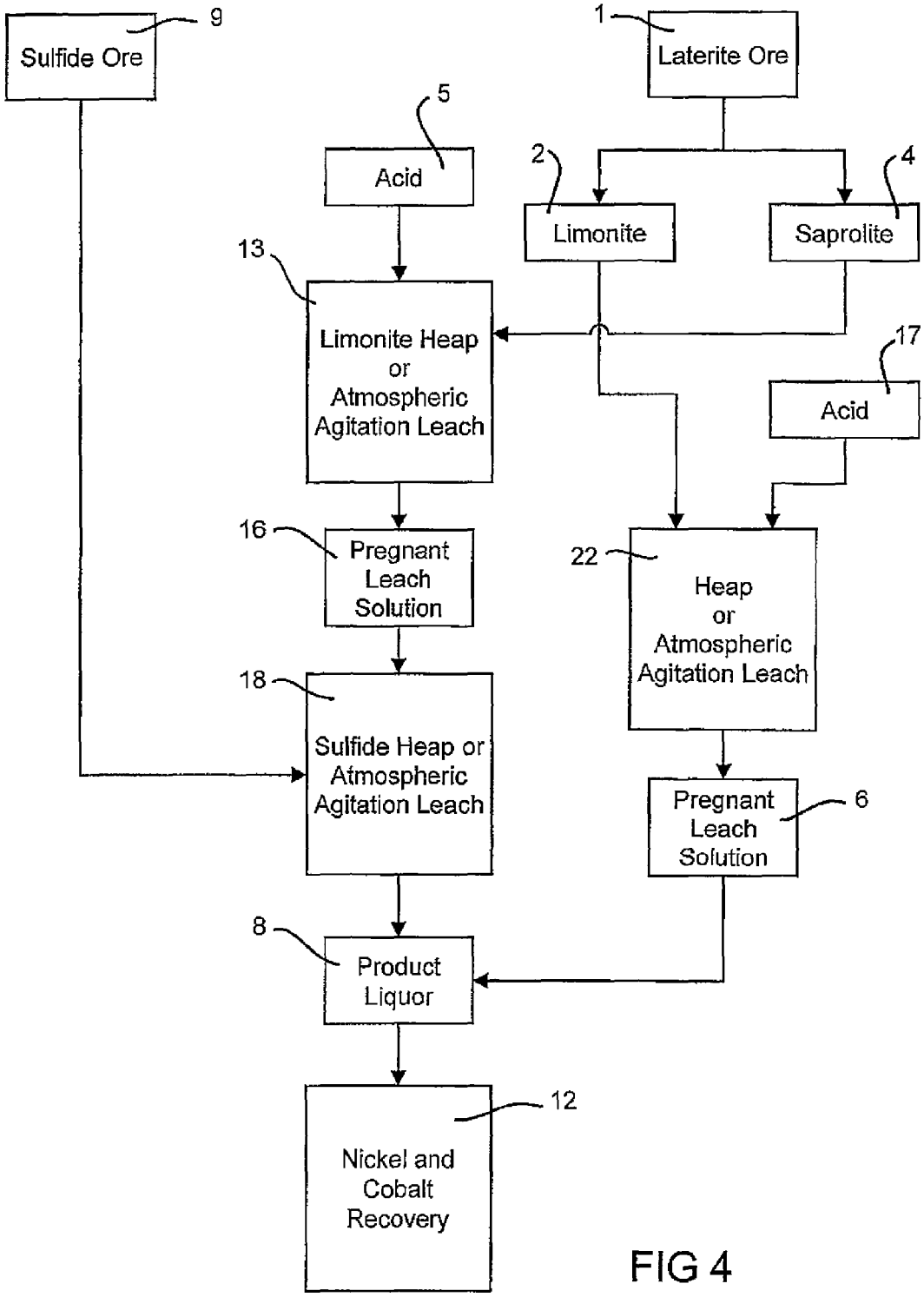
FIG. 4 illustrates an embodiment similar to that illustrated in FIG. 3; however the saprolite fraction is leached consecutively with the sulfide ore or concentrate in primary and secondary leach steps, while the limonite fraction is leached separately. The limonite fraction leachate from the limonite leach is combined with the product liquor from the secondary leach.

FIG. 4 illustrates a process similar to that of FIG. 3 except that the saprolite fraction (4) of the laterite ore is subjected to a primary leach step (13) by the addition of acid solution (5) and the pregnant leach solution (16) from this primary leach step, containing at least dissolved ferric, nickel and cobalt ions, is then used to leach the sulfide ore or concentrate (9) in a secondary leach step (18) to produce a product liquor (8). Both the primary and secondary leach steps are either heap or atmospheric agitation leach steps.

The ferric ion content in the pregnant leach solution (16) from the saprolite leach is sufficient to maintain the oxidation and reduction potential in the secondary leach step high enough to improve the leaching of nickel and cobalt from the sulfide ore or concentrate. The limonite fraction (2) is subjected to a separate heap or atmospheric leach step (22) to produce a limonite fraction leachate (6) containing at least nickel, ferric and cobalt ions. The limonite fraction leachate (6) from the limonite leach is added to the product liquor solution (8). Alternatively, the limonite fraction leachate may be added directly into the secondary leach step, if insufficient ferric ions are available during this step. Nickel and cobalt are then recovered from the product liquor solution (8) by conventional means (12).

Figure 5:
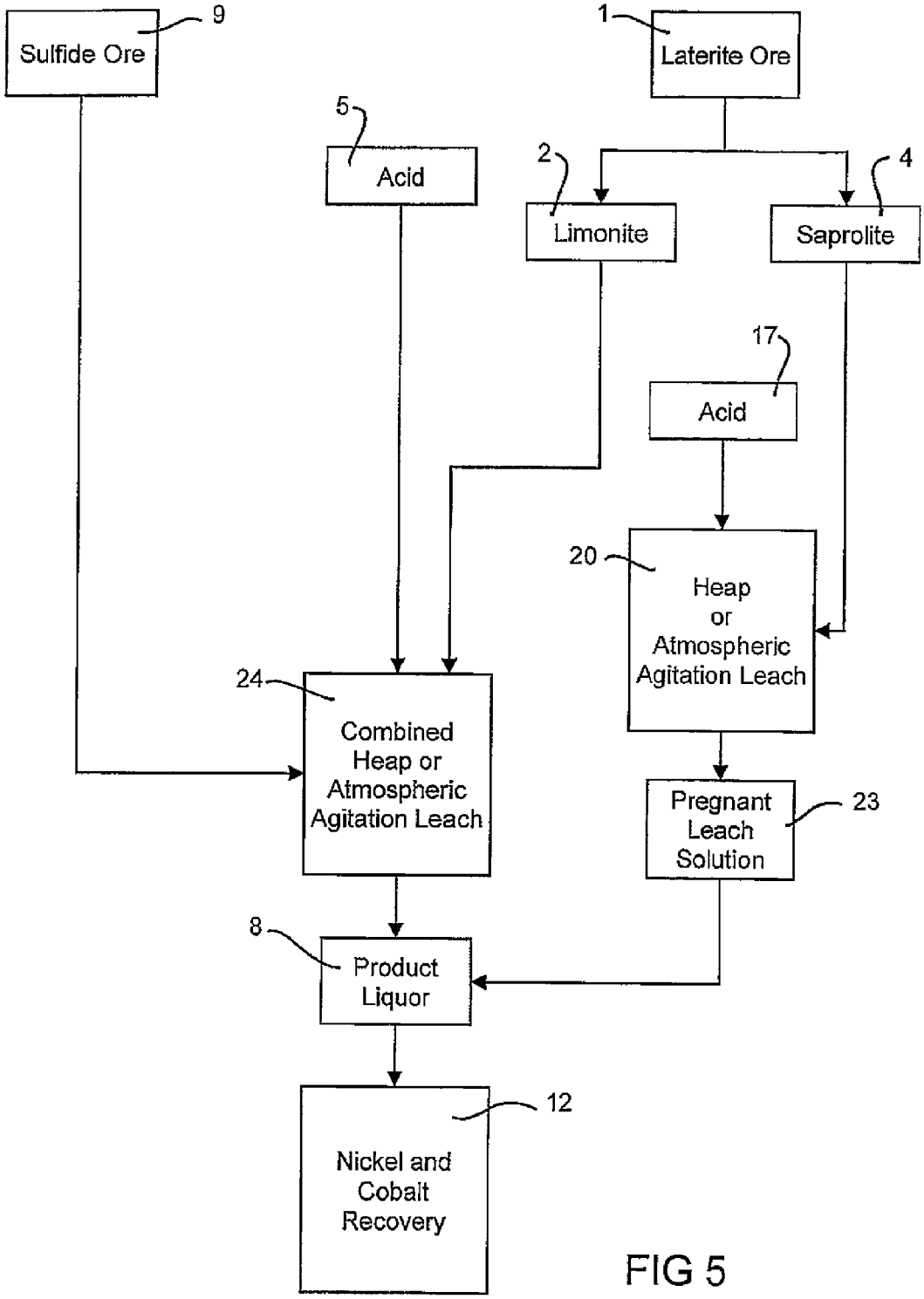
FIG. 5 illustrates an embodiment where the limonite fraction of the laterite ore, is leached simultaneously with the sulfide ore or concentrate while the saprolite fraction is leached separately. The saprolite fraction leachate from the saprolite leach is combined with the product liquor from the combined sulfide and limonite leach.
Figure 6:
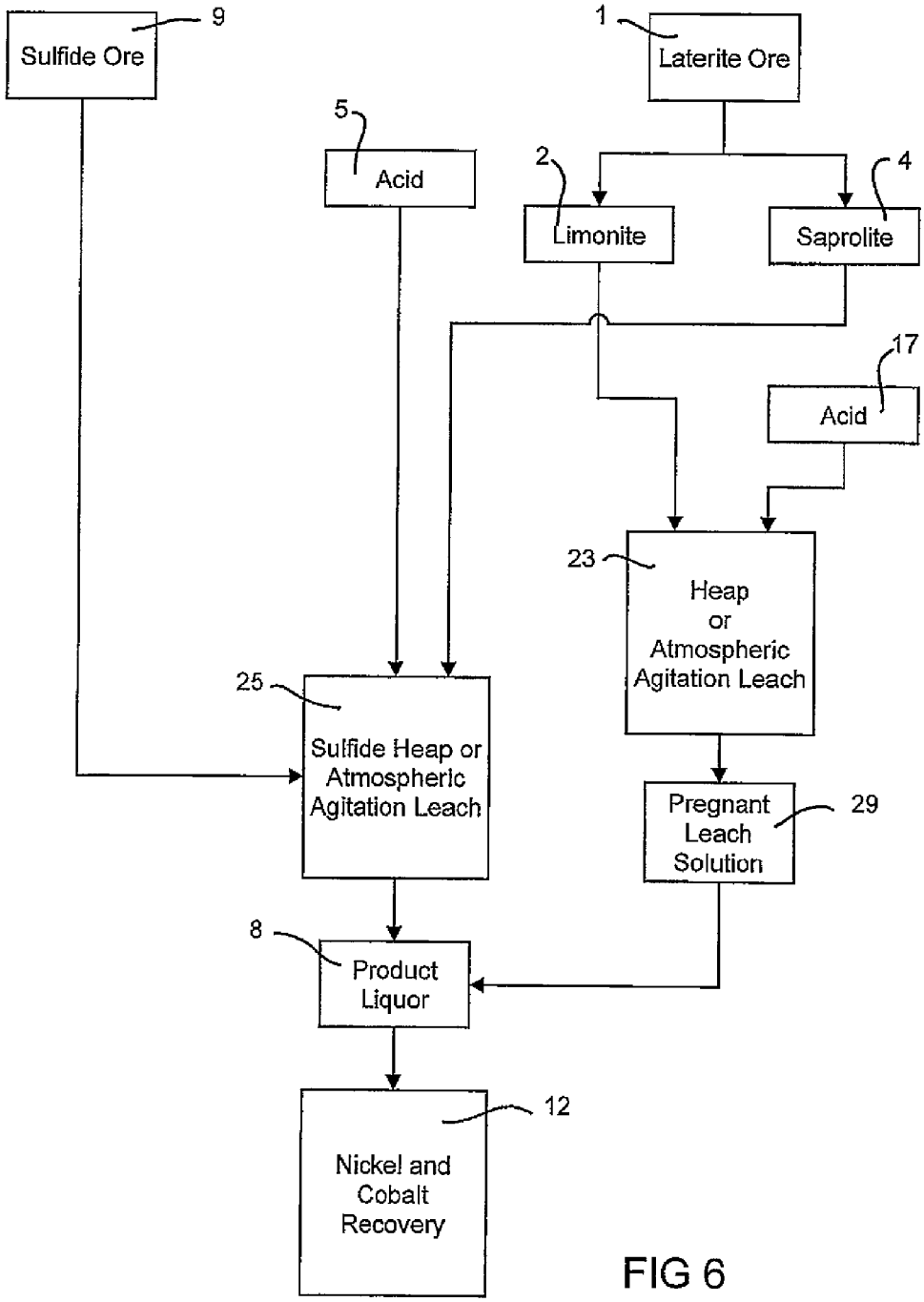
FIG. 6 illustrates an embodiment where the saprolite fraction of the laterite ore is leached simultaneously with the sulfide ore or concentrate while the limonite fraction is leached separately. The limonite fraction leachate from the limonite fraction leach is combined with the product liquor of the combined sulfide and saprolite leach.

FIGS. 5 and 6 illustrate the simultaneous leaching of the sulfide ore or concentrate (9) with either the limonite fraction (2) or saprolitic fraction (4) of the laterite ore. FIG. 5 illustrates an embodiment where, the limonite fraction (2) is combined with the sulfide ore or concentrate (9) and subjected to a combined heap or atmospheric agitation leach (24) by the addition of acid solution (5) in a combined leach step to produce a product liquor (8). The ferric ion content produced within the combined leach is sufficient to maintain the oxidation and reduction potential high enough to assist in leaching nickel and cobalt from the sulfide ore or concentrate.

The saprolite fraction (4) is subjected to a separate heap or atmospheric agitation leach process (20), and the saprolite fraction leachate (23) from the saprolite leach containing at least nickel, cobalt and ferric ions is combined with product liquor (8) from the combined limonite and sulfide leach step. Alternatively, the saprolite fraction leachate may be added directly into the combined leach step, if insufficient ferric ions are available during that step. Nickel and cobalt are then recovered from the product liquor (8) by conventional means (12).

FIG. 6 is similar to FIG. 5, except that the saprolite fraction (4) is combined with the sulfide ore or concentrate in the combined agitation leach step to produce a product liquor (8). The limonite fraction (2) is subjected to a separate heap or atmospheric agitation leach step (23) to produce a limonite fraction leachate containing at least nickel, cobalt and ferric ions. The limonite fraction leachate (29) is combined with the product liquor (8) from the combined sulfide and saprolite leach step. Alternatively, the limonite fraction leachate may be added directly into the combined leach step, if insufficient ferric ions are available during this step. Nickel and cobalt are recovered from the product liquor by standard techniques (12).

Figure 7:
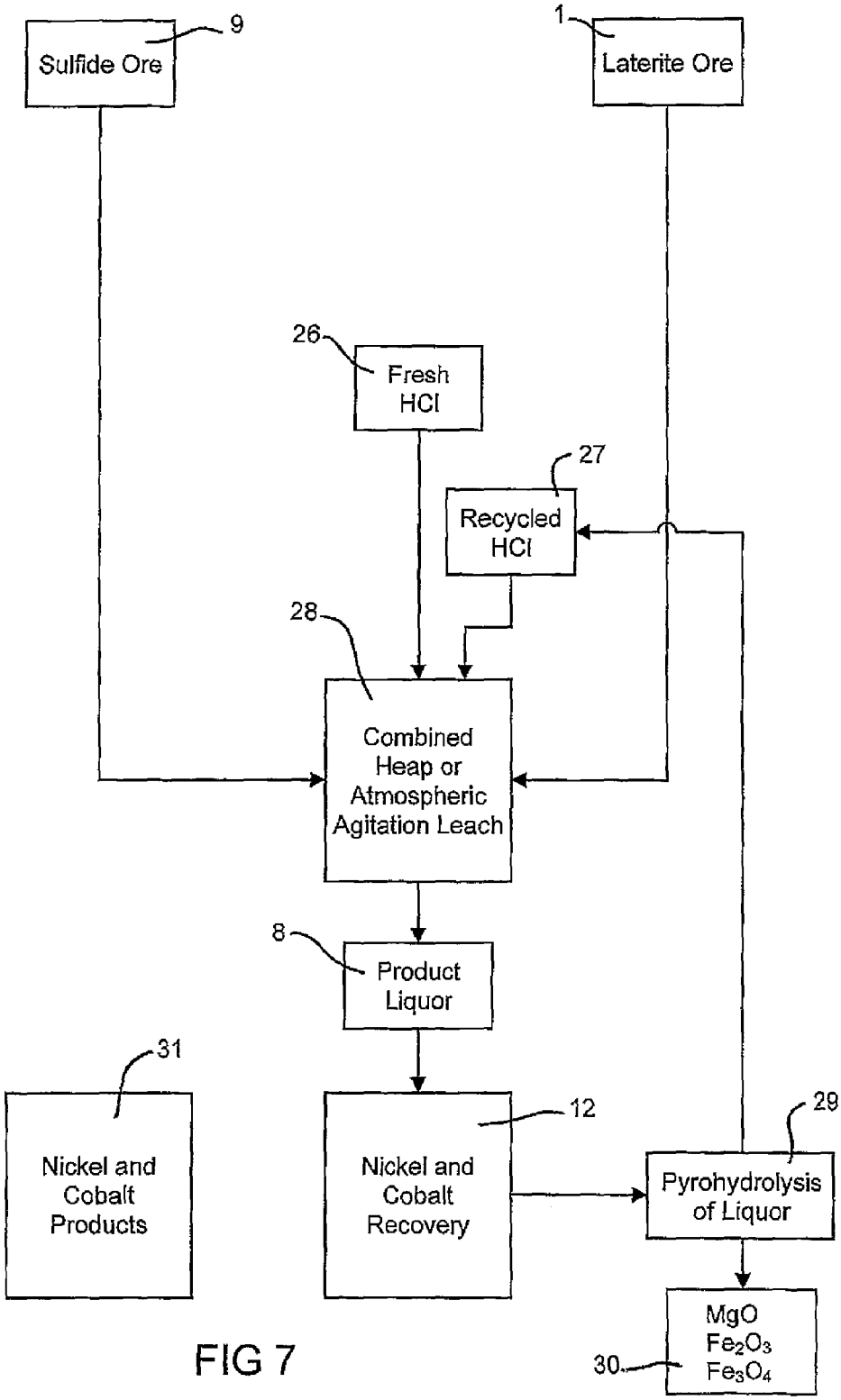
FIG. 7 illustrates an embodiment where the laterite ore is leached simultaneously with the sulfide ore or concentrate with hydrochloric acid to produce a product liquor. Part of the hydrochloric acid is recovered by pyrohydrolysis and recycled to the combined leach step.

FIG. 7 illustrates a simultaneous leach process wherein the laterite ore (1) is combined with the sulfide ore or concentrate in a combined heap or atmospheric leach step (28). A partially oxidised sulfide ore may be used instead or together with the laterite ore for this step. Fresh hydrochloric acid (26) is added and a product liquor (8) containing at least dissolved nickel and cobalt ions is produced. The ferric ion content produced within the combined leach is sufficient to maintain the oxidation and reduction potential high enough to assist in leaching nickel and cobalt from the sulfide ore or concentrate.

Nickel and cobalt are recovered from product liquor (8) by standard recovery means (12). However a portion of the product liquor (12) is subjected to pyrohydrolysis to recover some of the hydrochloric acid. This recovered hydrochloric acid (27) is recycled to the combined leach step. Magnesium is then removed as magnesium oxide which can be recovered for use for other purposes. Iron is also removed as haematite and/or magnetite. The nickel and cobalt may be recovered as products such as nickel and/or cobalt hydroxide or sulfide, cobalt carbonate or ferronickel or nickel matte.

EXAMPLES

Example 1

Leaching Reactivities of Oxidic and Sulfide Ore with Sulfuric Acid when Leached Individually Samples were taken from each of three zones of an ore body, a nickel oxide ore zone, a sulfide ore zone, and a sulfide transition ore zone between the two. The sulfide transition ore was essentially a sulfide ore with a mild degree of oxidation but with almost the same sulfur to nickel ratio as the sulfide zone ore. The composition of the major elements in each zone sample are listed in Table 3. One hundred grams of sample from each zone were ground with particle size of 100% less than 80 micron were leached at 80° C. for six hours with one litre sulfuric acid solution containing 100 g/L $H_2SO_4$. 98% $H_2SO_4$ was added into the reactor to keep constant acidity. Table 4 lists the weight and composition of leaching residue and Table 5 lists the leaching extractions calculated with residue weight and composition. The results show that the nickel and cobalt extractions declined in the order of oxide, transition and sulfide ore.

TABLE 3

Composition of Oxidic and Sulfide Ore Zone Sample of the Ore Body

| Sample | Wt. g | Al % | Co % | Fe % | Mg % | Ni % | S % | Si % |
|---|---|---|---|---|---|---|---|---|
| Oxide | 100 | 0.61 | 0.010 | 6.3 | 13.2 | 0.49 | 0.00 | 25.3 |
| Transition | 100 | 0.03 | 0.008 | 4.1 | 22.4 | 0.50 | 0.73 | 13.5 |
| Sulfide | 100 | 0.06 | 0.010 | 4.9 | 16.44 | 0.57 | 0.94 | 14.5 |

TABLE 4

Weight and Composition of Leaching Residue

| Sample | Wt. g | Al % | Co % | Fe % | Mg % | Ni % | S % | Si % |
|---|---|---|---|---|---|---|---|---|
| Oxide | 77.8 | 0.28 | 0.000 | 3.9 | 13.3 | 0.23 | 0.00 | 31.1 |
| Transition | 41.5 | 0.05 | 0.007 | 1.9 | 10.2 | 0.53 | 1.10 | 31.8 |
| Sulfide | 54.9 | 0.05 | 0.010 | 1.8 | 15.5 | 0.85 | 1.40 | 26.2 |

TABLE 5

Extractions of Oxide and Sulfide Ores at Constant 100 g/L $H_2SO_4$ and 80° C.

| Sample | ORP(SHE) mv | Al % | Co % | Fe % | Mg % | Ni % |
|---|---|---|---|---|---|---|
| Oxide | 833 | 64.3 | 100 | 51.8 | 21.6 | 63.5 |
| Transition | 693 | 30.8 | 63.7 | 80.8 | 81.1 | 56.0 |
| Sulfide | 663 | 17.7 | 12.2 | 63.0 | 62.8 | 18.1 |

Example 2

Consecutive Agitation Leach of Oxide and Sulfide Ore

Three hundred grams of oxide ore zone sample described in Example 1 were leached in an agitation reactor with 121 gram 98% sulfuric acid and 600 mL water at 80° C. for three hours. The pregnant leach solution contained 15 g/L total Fe including 14.4 g/L $Fe^{+3}$. The oxidation and reduction potential (ORP) was 808 mv (SHE). Then 72 grams of sulfide ore zone sample described in Example 1 were added into slurry. The pH was controlled in the range of 0.6-1.5 with adding 98% $H_2SO_4$ to prevent ferric ion precipitation. The ORP was in the range of 734 to 748 mv (SHE). The sulfide ore leaching lasted 11 hours. The product liquor contained 16 g/L Fe including 11.6 g/L $Fe^{+3}$. The overall nickel and cobalt extractions calculated with the composition of feed ore grade and leaching residue were 72.9% and 100% which was higher than the extractions with individual acidic leaches, shown in Table 5.

Example 3

Consecutive Agitation Leach of Oxide and Transition Ore

Three hundred grams of oxide ore zone sample described in Example 1 were leached in an agitation reactor with 134 gram 98% sulfuric acid and 600 mL water at 80° C. for three hours. The pregnant leach solution contained 17 g/L total Fe including 15.8 g/L $Fe^{+3}$. The ORP was 802 mv (SHE). Then 93 grams of transition ore zone sample described in Example 1 were added into slurry. The pH was controlled in the range of 0.5-1.5 with adding 98% $H_2SO_4$ to prevent ferric ions precipitation. The ORP was in the range of 726 to 745 mv (SHE). The transition ore leaching lasted 11 hours. The final product liquor contained 17 g/L total Fe including 11.2 g/L $Fe^{+3}$. The overall nickel and cobalt extractions calculated with the composition of feed ore and leaching residue were 71.7% and 100% respectively, which was higher than the extractions with individual acidic leaches, shown in Table 5.

Example 4

Column Leach of Oxide and the Mixture of Oxide/Sulfide and Oxide/Transition Ore Samples from an oxide ore zone, a transition ore zone and a sulfide ore zone, having the composition described in Table 3 and a size of 100% less than 25 mm were charged into columns for simulated heap leaching tests at ambient temperature with the conditions shown in Table 6. The acid dose for agglomeration was 50 kg $H_2SO_4$ per tonne dry ore. The feed acidity was 50 g/L $H_2SO_4$ and the irrigation flux was 15-18 Litre/(m2·hr). The metal extractions after seven or nine days respectively are summarized in Table 7.

TABLE 6

Column Leaching Conditions with Oxide, Transition Ore and Sulfide Ore

| Column ID | Diameter cm | Height cm | Oxide ore kg | Transition ore kg | Sulfide ore kg |
|---|---|---|---|---|---|
| Oxide 1 | 7.5 | 334 | 20.00 | 0 | 0 |
| Oxide 2 | 7.5 | 338 | 20.00 | 0 | 0 |
| O/S* | 7.5 | 334 | 13.59 | 0 | 6.40 |
| O/T** | 7.5 | 344 | 12.57 | 6.42 | 0 |

*Mixture of oxide ore and sulfide ore

**Mixture of oxide ore and transition sulfide ore

TABLE 7

Column Leaching Extractions (%) of Oxide and Sulfide at 9 Day

| Sample | Operation day | Acid Consumption Kg/t dry ore | Al Ext. % | Co Ext. % | Fe Ext. % | Mg Ext. % | Ni Ext. % |
|---|---|---|---|---|---|---|---|
| Oxide 1 | 9 | 75 | 16.65 | 41.43 | 5.68 | 8.58 | 23.66 |
| Oxide 2 | 9 | 72 | 17.22 | 42.45 | 5.21 | 8.44 | 23.56 |
| O/S* | 7 | 74 | 29.94 | 51.06 | 8.06 | 7.55 | 17.28 |
| O/T** | 7 | 74 | 11.33 | 62.90 | 5.16 | 8.66 | 28.30 |

*Mixture of oxide ore and sulfide ore

**Mixture of oxide ore and transition sulfide ore

The above description is intended to be illustrative of the preferred embodiments of the present invention. Variations to the invention without departing from the spirit or ambit described herein should also be considered to form part of the invention.

The invention claimed is:

1. A process for the recovery of nickel and cobalt from nickel and cobalt containing ores, said process including the steps of:

(a) providing i. a laterite ore and/or a partially oxidised sulfide ore, and ii. a sulfide ore or concentrate;

(b) leaching the laterite ore and/or partially oxidised sulfide ore with an acid solution in a primary leach step, to produce a pregnant leach solution containing dissolved nickel, cobalt and ferric ions;

(c) leaching the sulfide ore or concentrate with the pregnant leach solution in a secondary leach step to produce a product liquor containing dissolved nickel and cobalt ions; and (d) recovering the nickel and cobalt from the product liquor;

wherein the ferric ion content in the pregnant leach solution maintains the oxidation and reduction potential in the secondary leach step such that the ferric ions act as a lixiviant and/or an oxidant during leaching of the sulfide ore or concentrate.

2. A process according to claim 1 wherein the ferric ion content in the pregnant leach solution is greater than 10 g/L.

3. A process according to claim 1 wherein the ferric ion content in the pregnant leach solution is greater than 30 g/L.

4. A process according to claim 1 wherein the ferric ion content in the pregnant leach solution is sufficient to maintain the oxidation and reduction potential in the secondary leach step between 690 to 900 my (SHE).

5. A process according to claim 4 wherein the ferric ion content in the pregnant leach solution is sufficient to maintain the oxidation and reduction potential in the secondary leach step between 740 to 800 my (SHE).

6. A process according to claim 1 wherein the laterite ore is first separated into limonite and saprolite fractions;

the limonite fraction is leached with an acid solution in a primary leach step to produce the pregnant leach solution;

the sulfide ore or concentrate is leached with the pregnant leach solution in a secondary leach step to produce a the product liquor;

the saprolite fraction is leached separately from the limonite to produce a saprolite fraction leachate and the saprolite fraction leachate is added to either the product liquor or the secondary leach step.

7. A process according to claim 1 wherein the laterite ore is first separated into limonite and saprolite fractions;

the saprolite fraction is leached with an acid solution in a primary leach step to produce the pregnant leach solution;

the sulfide ore or concentrate is leached with the pregnant leach solution in a secondary leach step to produce the product liquor;

the limonite fraction is leached separately from the saprolite to produce a limonite fraction leachate;

and the limonite fraction leachate is added to either the product liquor or the secondary leach step.

8. A process for the recovery of nickel and cobalt from nickel and cobalt containing ores, said process including the steps of:

(a) providing i) a laterite and/or a partially oxidised sulfide ore, and ii) a sulfide ore or concentrate, (b) combining the sulfide ore or concentrate and the laterite and/or partially oxidised sulfide ore, and simultaneously leaching in a combined leach step the the sulfide ore or concentrate and the laterite and/or partially oxidised sulfide ore with an acid solution to release nickel, cobalt and ferric ions and to produce a product liquor containing dissolved nickel and cobalt ions; and (c) recovering nickel and cobalt from the product liquor;

wherein the content of ferric ion released during the combined leach step maintains the oxidation and reduction potential such that the ferric ions act as a lixiviant and/or an oxidant during leaching of the sulfide ore or concentrate and the laterite and/or partially oxidised sulfide ore.

9. A process according to claim 8 wherein the laterite ore is first separated into limonite and saprolite fractions;

the limonite fraction is combined with the sulfide ore or concentrate and leached with an acid solution in a combined leach step;

the saprolite fraction is separately leached to produce a saprolite fraction leachate; and the saprolite fraction leachate is added to either the product liquor or the combined leach step.

10. A process according to claim 8 wherein the laterite ore is separated into limonite and saprolite fractions;

the saprolite fraction is combined with the sulfide ore or concentrate and leached with an acid solution in a combined leach step;

the limonite fraction is separately leached to produce a limonite fraction leachate; and the limonite fraction leachate is added to either the product liquor or the combined leach step.

11. A process according claim 6 wherein the laterite ore is further separated into its a nontronite fraction, and the nontronite fraction is processed either in place of, or together with either of the limonite or saprolite fractions.

12. A process according to claim 8 wherein the ferric ion content released during the combined leach step is greater than 10 g/L.

13. A process according to claim 8 wherein the ferric ion content released during the combined leach step is greater than 30 g/l.

14. A process according to claim 8 wherein the ferric ion content released during the combined leach step is sufficient to maintain the oxidation and reduction potential in the combined leach step between 690 to 900 my (SHE).

15. A process according to claim 8 wherein the ferric ion content released during the combined leach step is sufficient to maintain oxidation and reduction potential in the combined leach step between 740 to 820 my (SHE).

16. A process according to claim 1 wherein the primary and secondary leach steps are conducted separately under either heap leach or atmospheric pressure agitation leach conditions.

17. A process according to claim 8 wherein the simultaneous leach is conducted under heap or atmospheric pressure agitation leach conditions.

18. A process according to claim 1 wherein the secondary leach step is sparged with air or oxygen.

19. A process according to claim 1 wherein the acid solution is a hydrochloric or sulfuric acid solution.

20. A process according to claim 19 wherein a portion of the hydrochloric acid is recovered from the product liquor by pyrohydrolysis, wherein the recovered hydrochloric acid is recirculated to the primary or combined leach step.

21. A process according to claim 20 wherein magnesium is removed during the pyrohydrolysis step as magnesium oxide, and iron is removed as haematite or magnetite.

22. A process according to claim 1 wherein nickel and cobalt are recovered from the product liquor by ion exchange, solvent extraction, neutralisation, carbonation or sulfidisation.

23. A process according to claim 22 wherein the nickel and cobalt are recovered as pure or mixed hydroxides, sulfides, and carbonates, or the nickel is recovered as ferronickel or nickel matte.

24. A process according to claim 1 wherein the sulfide ore and the laterite and/or partially oxidised sulfide ore are located in ore bodies which are geographically close.

25. A process according claim 7 wherein the laterite ore is further separated into a nontronite fraction, and the nontronite fraction is processed either in place of, or together with either of the limonite or saprolite fractions.

26. A process according claim 9 wherein the laterite ore is further separated into a nontronite fraction, and the nontronite fraction is processed either in place of, or together with either of the limonite or saprolite fractions.

27. A process according claim 10 wherein the laterite ore is further separated into a nontronite fraction, and the nontronite fraction is processed either in place of, or together with either of the limonite or saprolite fractions.

28. A process according to claim 8 wherein the combined leach step is sparged with air or oxygen.

* * * * *

UNITED STATES PATENT AND TRADEMARK OFFICE

CERTIFICATE OF CORRECTION

PATENT NO. : 7,871,584 B2
APPLICATION NO. : 11/745542
DATED : January 18, 2011
INVENTOR(S) : Houyuan Liu et al.

It is certified that error appears in the above-identified patent and that said Letters Patent is hereby corrected as shown below:

In the Claims

In column 15, claim 4, line 50, after "between 690 to 900" replace "my" with --mv--.

In column 15, claim 5, line 54, after "between 740 to 800" replace "my" with --mv--.

In column 16, claim 11, line 55, after "further separated into" delete "its".

In column 16, claim 14, line 67, after "between 690 to 900" replace "my" with --mv--.

In column 17, claim 15, line 4, after "between 740 to 820" replace "my" with --mv--.

In column 18, claim 25, line 8, after "process according" insert --to--.

In column 18, claim 26, line 12, after "process according" insert --to--.

In column 18, claim 27, line 16, after "process according" insert --to--.

Signed and Sealed this
Fifth Day of July, 2011

David J. Kappos

David J. Kappos
*Director of the United States Patent and Trademark Office*